United States Patent [19]

Corradi

[11] 4,265,152

[45] May 5, 1981

[54] APPARATUS FOR LONGITUDINALLY AND TRANSVERSELY CUTTING STRIP MATERIAL

[75] Inventor: Gabriel Corradi, Soissons, France

[73] Assignee: Astin France Assistance Technique Industrielle, France

[21] Appl. No.: 30,815

[22] Filed: Apr. 17, 1979

[30] Foreign Application Priority Data

Feb. 5, 1979 [FR] France ..... 79 03791

[51] Int. Cl.[3] ..... B31B 1/16

[52] U.S. Cl. ..... 83/106; 83/302; 83/303; 83/408

[58] Field of Search ..... 83/302, 303, 408, 106

[56] References Cited

U.S. PATENT DOCUMENTS

| | | | |
|---|---|---|---|
| 1,867,335 | 7/1932 | Strecker | 83/302 |
| 1,973,863 | 9/1934 | Betjeman | 83/303 X |
| 3,296,908 | 1/1967 | Shields | 83/303 |
| 4,041,819 | 8/1977 | Chu | 83/302 |

*Primary Examiner*—J. M. Meister

*Attorney, Agent, or Firm*—Robert E. Burns; Emmanuel J. Lobato; Bruce L. Adams

[57] ABSTRACT

A cutter for cross cutting a main strip of material, or several elemental strips resulting from cutting of this strip in the longitudinal direction incorporates two cutting devices for cutting respectively over a width less than that of the strip, which devices are placed side-by-side at the same level in a direction parallel to the width of the strip, a cutting device for cutting over a width at least equal to that of the strip, at a level different from said level, and independently-adjustable means for the individual control of the three cutting devices for causing cutting at predetermined times which can be adjusted independently.

5 Claims, 2 Drawing Figures

APPARATUS FOR LONGITUDINALLY AND TRANSVERSELY CUTTING STRIP MATERIAL

FIELD OF THE INVENTION

The present invention relates to a cutter for the tranverse cutting of a main strip of material, or several elemental strips, which are the result of cutting the main strip in the longitudinal direction.

It relates in particular to cutting to the desired format, articles in large numbers, from a strip produced continuously over a width which may be greater than that required.

By way of example, it is possible to cut to the desired format a sheet of cardboard, after it is formed, in order to make blanks from the latter which, after cutting and folding, may constitute boxes.

BACKGROUND OF THE INVENTION

It is known that in order to eliminate wastage as far as possible, one seeks to make the best use of the width of strip material and that, when its width does not correspond substantially to one of the dimensions of a given type of blank to be produced, blanks of different dimensions are produced simultaneously by selecting a method of cutting such that a maximum width of the strip is utilised.

To this end, the strip is firstly cut longitudinally into a plurality of elemental strips, generally two or three in number, the width of which corresponds to one of the dimensions of the blanks to be produced, and then each elemental strip is cut transversely to the desired length in order to obtain the desired blanks.

This cutting up of the various elemental strips is effected by a number of cross cutting devices equal to the number of elemental strips and the operation of each of which is independent, since the various basic strips are rarely cut to the same length.

At present, each of the cutting devices, the number of which is equal to that of the elemental strips, is designed so as to be able to cut across the entire width of the main strip, and, if it is impossible to impart lateral movements to the main strip or elemental strips, it is necessary to place these various cross cutting devices one above the other, which results in a bulky arrangement and generally has the result of limiting them to two or three in number, which also limits the number of elemental strips to two, and consequently also limits the possibilities of obtaining the best use of the width of the main strip.

Another drawback of such an arrangement is its high cost as regards its capital outlay and running costs, if one takes into account the fact that only one of the cutting devices is intended to be used occasionally over its entire width, any other cutting device being used solely when the mainstrip has been sub-divided into a plurality of elemental strips, which in other words means that it is only ever used over a part of its width.

SUMMARY OF THE INVENTION

The invention proposes a cutter which obviates or mitigates these drawbacks.

To this end, the invention proposes a cutter making it possible to cut up to three elemental strips transversely, by associating two cutting devices having different widths of cut, namely a device whose width of cut is slightly greater than half the width of the main strip and a device whose width of cut corresponds substantially to the complement of this first width of cut making up the total width of the initial strip, with a third device whose width of cut in turn corresponds to the width of the main strip. There is thus obtained a cutter which is simultaneously able to produce up to three different formats, on two levels only, since the two devices having a smaller width of cut are located at the same level.

The bulk of this cutter which makes it possible to produce up to three different formats is similar to that of a traditional cutter able to produce only two formats simultaneously.

Thus, with a cutter of equivalent bulk, one has a greater choice in the possibilities of combing the various formats to be produced, in order to make the best possible use of the width of the initial strip.

Furthermore, a cutter according to the invention is less expensive as regards capital outlay and energy requirements than a conventional cutter offering the possibility of the simultaneous production of three formats, since the two cutting devices acting over a width less than the width of the initial strip are less expensive than devices able to operate over the entire width of the latter, and, owing to their reduced weight, require less energy to operate.

According to the present invention there is provided a cutter for the cross cutting of a main band of sheet material or several elemental strips resulting from the cutting of this band in a longitudinal direction, comprising two cutting devices for cutting respectively over a width less than that of the main band, which are placed side-by-side at the same level in a direction parallel to the width of the main band, a cutting device for cutting over a width at least equal to that of the main band, at a different level, and independently-adjustable means for the individual control of the three cutting devices for effecting cutting at predetermined times.

BRIEF DESCRIPTION OF THE DRAWING

An embodiment of the present invention will now be described, by way of example with reference to the accompanying drawing, in which.

DESCRIPTION OF THE PREFERRED EMBODIMENTS

Figure 1:
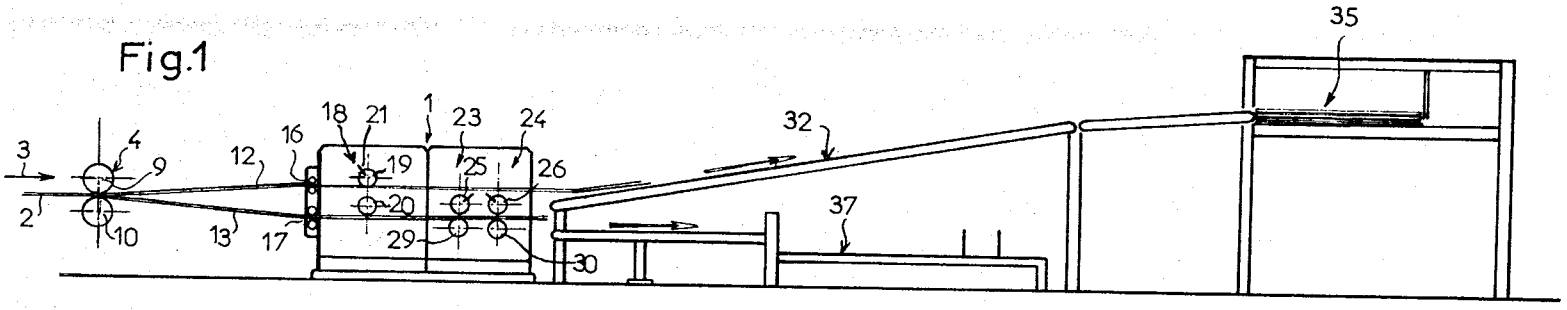
FIGS. 1 and 2 are respectively a side elevation view and a plan view of a cutting installation using a cutter according to the invention and designated by the general reference numeral 1.
Figure 2:
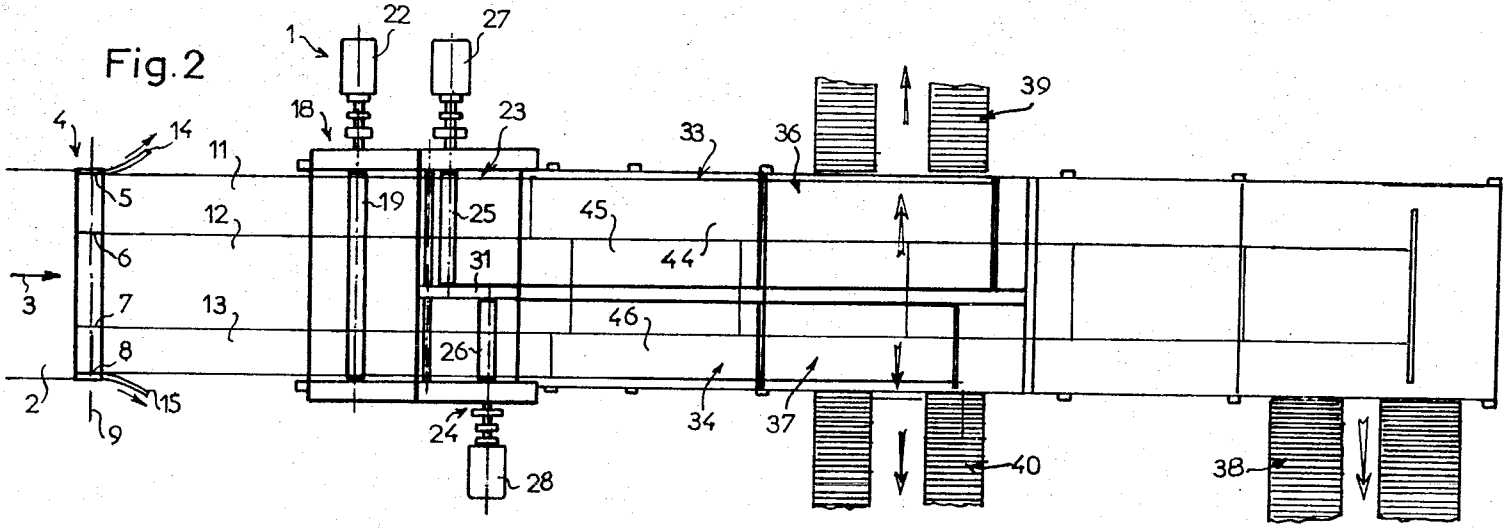

The reference numeral 2 designates an initial strip or band of sheet material such, for example, as a sheet of paper of substantial width, which travels in a horizontal attitude in the longitudinal direction, as designated by an arrow 3.

In the example illustrated, corresponding to the case where rectangular blanks 44, 45, 46 respectively of three different formats are produced simultaneously from the band 2, the cutting layout is such that the sum of the dimensions of these blanks arranged over the width of the band 2 is as close as possible to but slightly less than this width. The band 2 firstly passes through a device 4 of known type, intended to cut the strip in the longitudinal direction.

To this end, the device 4 comprises, in known manner, four cutting discs 5, 6, 7, 8 mounted to rotate about a common axis 9 arranged transversely with respect to the direction of movement 3. These four cutters are able to penetrate the band 2 through one of the faces of the latter, the other face of this band resting on a counterpart 10.

On leaving the device 4, the main band 2 has been divided over its width into three elemental strips 11, 12, 13, the width of which corresponds to one of the dimensions of the blanks to be produced, 44, 45, 46 respectively, or to a multiple of this dimension, and also into waste strips 14 and 15 corresponding to selvedges, which are removed laterally.

As they move forwards, the strips 11 to 13 separate as regards height, the side strips 11 and 13 travelling downwards with respect to the central strip 12, which travels upwards. The strip 12 thus enters the cutter 1 through an upper inlet 16 and the two strips 11 and 13 enter through a lower inlet 17.

Generally and as is also the case in the example illustrated, it is preferably the wider strip which is directed towards the upper cutter.

The upper inlet 16 constitutes the inlet to a cutting device of known type, used in this example over the width corresponding to the strip 12, but which could also be used for transverse cutting of the strip 2 over its entire width if this proved necessary.

The cutter 18, which is of the rotary type in the example illustrated, comprises an upper drum 19 and a lower drum 20, mounted to rotate about parallel horizontal axes, perpendicular to the direction of movement of the strip 12, i.e. also to the direction of travel 3 of the initial band 2, respectively opposite the upper and lower faces of the strip 12. The length of these two drums, measured parallel to their axis, is at least equal to the width of the band 2 and they are arranged such that they are able to cover the latter from one edge to the other when it engages between them.

In known manner, on its periphery, along one of its generatrices and over its entire length, the drum 19 comprises a projecting blade 21 which, when it is placed opposite the periphery of the counter drum 20, penetrates the material of the strip 12 and cuts the latter transversely. The rotation of the roller 19, whose speed determines the time elapsing between two passages of the blade 21 through a position in which it is opposite the drum 20 and cuts the strip 12 and consequently the dimension of the blanks 45 obtained corresponding to the direction of the length of the band 2, taking into account the speed of travel of the latter, are controlled by a driving arrangement 22 which can be adjusted separately.

The lower inlet 17 is in turn common to two lower cutters respectively 23 and 24, which in this case are rotary cutters like the upper cutter 18.

As is more apparent from FIG. 1, these two cutters are able to act over widths less than the total width of the band 2. These widths are preferably different, as illustrated and such that, when they are added together, they correspond approximately to the total width of the band 2. These widths are in this case respectively slightly greater and slightly less than half the width of the band 2.

Like the upper cutter 18, each of the lower cutters 23 and 24 comprises an upper drum 25 and 26 respectively, mounted to rotate about its horizontal axis respectively under the action of a motor 27 and 28 which can be adjusted independently, and each comprising on its periphery a blade projecting along one generatrix. Each of the lower cutters 23 and 24 also comprises in vertical alignment with the upper roller, a lower roller respectively 29 and 30, constituting the counterpart such that the strips 11 and 13 engaged respectively between the rollers 25 and 29 and between the rollers 26 and 30 are cut when the blade occupies its lower position. Similarly to the axes of the rollers 19 and 20, the axes of the rollers, 25, 26, 29 and 30 are arranged at right-angles to the direction 3.

The respective rollers of the lower cutters 23 and 24 may be placed side-by-side over the width of the band 2 or, as illustrated, staggered slightly in the direction 3. In any case, they are arranged such that each is able to provide cross cutting of a band resulting from the strip 2 and whereof one of the longitudinal edges is constituted respectively by one or other of the longitudinal edges of this strip 2, after removal of the selvedges 14 and 15.

Thus, whatever the width of the basic strips resulting from the band 2 in the region of the cutter 4, whether there are two or three such basic strips, by suitably selecting their relative position, i.e. the position of the cutters 5 to 8, it is possible to cut them into sections independently of each other by means of the arrangement of three cutters, 18, 23, 24. In particular, as in the example illustrated, the cutters 23 and 24 may be used to cut the side strips transversely, the upper cutter 18 being used to cut the central strip in particular, when the latter is made to pass plumb with the junction 31 between the two cutters 23 and 24 as in the example illustrated. If the band 2 is sub-divided into two basic strips at the cutter 4, one of these basic strips inevitably having a width at the most equal to half the width of the initial band 2 may be cut by one of the lower cutters 23, 24 and the other strip is cut by the upper cutter 18. Finally, if at the cutter 4, only the selvedges 14 and 15 are cut from the band 2, it may be cut by the upper cutter 18.

On leaving the arrangement of cutters 1, the blanks are received by endless conveyors of known type, respectively an upper conveyor 32 for the blanks such as 45 coming from the upper cutter 18, and lower conveyors 33 and 34, at the same level, for blanks coming respectively from the lower cutter 23 and the lower cutter 24. The upper conveyor 32 which can receive blanks having the width of the band 2, conveys these blanks to a stacking device 35 of known type, also capable of receiving blanks having such a width. The conveyor 33 which is capable of receiving blanks having a width corresponding to the width of cut of the cutter 23, conveys these blanks to a stacking device 36 also capable of receiving such blanks. The conveyor 34 which can receive blanks whose width corresponds to the width of cut of the cutter 24, conveys these blanks to a stacking device 37 which is capable of receiving such blanks and which is located at the side of the device 36. Lateral discharge means 38, 39 and 40 respectively are provided for discharging the piles of blanks received respectively at 35, 36 and 37, the two devices 39 and 40 being respectively located on either side of the machine.

When the machine is intended to be placed along a wall, it is also possible to use stacking means 36 and 37 arranged so as to allow a lateral discharge of the stacks from the same side of the machine, in order to allow the three stacks of blanks to be received on this same side.

Naturally, the invention may have numerous variations with respect to the embodiment described and illustrated and falling within the scope of the accompanying claims. In particular, the rotary cutters could be replaced by any other type of cutter and in particular by reciprocating cutters.

What is claimed is:

1. A cutting machine for dividing a band of sheet material into a multiplicity of blanks comprising:

means for moving said band in a longitudinal direction, longitudinal cutting means for dividing said band longitudinally into at least three strips comprising first and second side strips spaced from one another and an intermediate strip between said two side strips, first and second transverse cutting devices disposed adjacent one another at a first level in position to cut said first and second side strips respectively transversely of their length, each of said first and second cutting devices having a cutting width less than the width of said band, the combined cutting width of said first and second cutting devices being at least approximately equal to the width of said band, a third transverse cutting device disposed at a second level and having a cutting width at least equal to the width of said band, and means for directing said first and second side strips to said first and second transverse cutting devices respectively at said first level and for directing said intermediate strip to said third transverse cutting devices at said second level, whereby said strips are independently cut transversely into a multiplicity of blanks of predetermined sizes.

2. A cutting machine according to claim 1, in which said transverse cutting devices are rotary cutters.

3. A cutting machine according to claim 2, in which the axes of rotation of said first and second transverse cutting devices are offset from one another.

4. A cutting machine according to claim 1, in which said first cutting device has a cutting width less than half the width of said band and said second cutting device has a width greater than the width of said band.

5. A cutting machine according to claim 1, further comprising first and second conveying means disposed side-by-side at a first level for receiving and transporting blanks cut by said first and second transverse cutting devices respectively and third conveying means at a second level for receiving and transporting blanks cut by said third transverse cutting device.

* * * * *